US009601845B2

(12) United States Patent
Ando

(10) Patent No.: US 9,601,845 B2
(45) Date of Patent: Mar. 21, 2017

(54) CONNECTOR DEVICE

(71) Applicant: Yazaki Corporation, Tokyo (JP)

(72) Inventor: Shuhei Ando, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/049,733

(22) Filed: Feb. 22, 2016

(65) Prior Publication Data

US 2016/0172770 A1 Jun. 16, 2016

Related U.S. Application Data

(63) Continuation of application No. PCT/JP2014/075214, filed on Sep. 24, 2014.

(30) Foreign Application Priority Data

Sep. 24, 2013 (JP) ..... 2013-197126

(51) Int. Cl.
*H01R 13/187* (2006.01)
*H01R 4/50* (2006.01)
(Continued)

(52) U.S. Cl.
CPC ..... *H01R 4/5008* (2013.01); *H01R 4/4881* (2013.01); *H01R 13/193* (2013.01); *H01R 13/62911* (2013.01); *H01R 13/187* (2013.01)

(58) Field of Classification Search
CPC ... H01R 13/187; H01R 13/111; H01R 13/113; H01R 13/15; H01R 13/6275; H01R 13/6272; H01R 13/6273
(Continued)

(56) References Cited

U.S. PATENT DOCUMENTS 2,393,083 A * 1/1946 Wizegarver ..... H01R 13/33 439/268
2,997,681 A * 8/1961 Klassen ..... H01R 13/193 136/235
(Continued)

FOREIGN PATENT DOCUMENTS

JP 59-9480 U 1/1984
JP 4209775 B2 1/2009
(Continued)

OTHER PUBLICATIONS

Written Opinion dated Oct. 28, 2014 issued by the International Searching Authority in counterpart International Patent Application No. PCT/JP2014/075214 (PCT/ISA/237).
(Continued)

*Primary Examiner* — Hien Vu
(74) *Attorney, Agent, or Firm* — Sughrue Mion, PLLC

(57) ABSTRACT

A contact member provided inside a cylindrical contact holder of a female terminal has a diameter variable portion including a number of metal string members whose both ends are held by front side and rear side holding rings. When a slider is moved in a connector engaged state, a linear movement of a cam projection provided on the slider is converted into a rotational movement of a rotary ring by a cam groove 290, so that the front side holding ring fixed to the rotary ring is rotated to apply a twist to the diameter variable portion, whereby the metal string members are deformed into a hyperboloidal shape and the smallest inner diameter portion thereof is brought into pressure contact with a male terminal.

5 Claims, 11 Drawing Sheets

(51) Int. Cl.
*H01R 13/193* (2006.01)
*H01R 13/629* (2006.01)
*H01R 4/48* (2006.01)

(58) Field of Classification Search
USPC ..... 439/843, 848, 357, 358, 268
See application file for complete search history.

(56) References Cited

U.S. PATENT DOCUMENTS

| | | | | |
|---|---|---|---|---|
| 5,439,393 | A | 8/1995 | Watson | |
| 5,628,644 | A | 5/1997 | Szalay et al. | |
| 6,899,571 | B1 | 5/2005 | Koch et al. | |
| 9,093,764 | B2 * | 7/2015 | Manahan ..... | H01R 13/11 |
| 2003/0068931 | A1 | 4/2003 | Swearingen et al. | |
| 2003/0077950 | A1 | 4/2003 | Swearingen et al. | |
| 2004/0003498 | A1 | 1/2004 | Swearingen et al. | |
| 2013/0012047 | A1 | 1/2013 | Ishikawa et al. | |

FOREIGN PATENT DOCUMENTS

| | | | |
|---|---|---|---|
| JP | 2013-187167 | A | 9/2013 |
| WO | 2011/118656 | A1 | 9/2011 |

OTHER PUBLICATIONS

International Search Report dated Oct. 28, 2014 issued by International Searching Authority in counterpart International Patent Application No. PCT/JP2014/075214 (PCT/ISA/210).
Written Opinion dated Oct. 28, 2014 issued by International Searching Authority in counterpart International Patent Application No. PCT/JP2014/075214 (PCT/ISA/237).

* cited by examiner

CONNECTOR DEVICE

CROSS REFERENCE TO RELATED APPLICATIONS

This application is a continuation of International Patent Application No. PCT/JP2014/075214 filed on Sep. 24, 2014, claiming priority from Japanese Patent Application No. 2013-197126 filed on Sep. 24, 2013, the contents of which are incorporated herein by reference.

FIELD OF INVENTION

The present invention relates to a connector device.

BACKGROUND ART

JP 4209775 B2 describes an example of a female terminal having a radially resilient contact member. As shown in FIGS. 12 and 13, this female terminal 10 has a cylindrical sleeve 20, and a cylindrical contact member 30 inserted inside the cylindrical sleeve 20. A plurality of engaging parts 21 are arranged at an interval in a circumferential direction, at both axial ends of the cylindrical sleeve 20. The cylindrical contact member 30 has a plurality of axially extending contact strips (thin strips for contacts) 31, and also has a plurality of engaging parts 32 arranged at an interval in a circumferential direction, at both axial ends of the cylindrical contact member 30.

The engaging parts 32 at the both ends of the cylindrical contact member 30 are engaged with the engaging parts 21 at the both ends of the cylindrical sleeve 20 in a twisted positional relationship, whereby an assembly of the plurality of the contact strips 31 held in a twisted state forms a hyperboloid. The female terminal 10 is configured such that a portion of the hyperboloid formed by the cylindrical contact member 30 that has been bent in an inwardly convex manner serves as a spring portion having radial resiliency. When a male terminal, which is not shown, is inserted into this female terminal 10, the contact member 30 pushed by the male terminal is elastically deformed and applies a contact load to the male terminal, whereby an electrical connection between the male terminal and the female terminal is made.

According to the female terminal described above, the contact member is formed in a hyperboloidal shape in advance in a permanent manner from the beginning, before the male terminal is inserted. Thus, the male terminal needs to be inserted into the female terminal, while receiving a spring load from the contact member. Therefore, there is a problem that the spring load causes a friction resistance and increases the insertion load. Because the insertion involves receiving of the friction resistance, there is also a problem that contact portions of the male terminal and the female terminal are easily worn away.

SUMMARY OF INVENTION

Illustrative aspects of the present invention provide connector device having a female terminal that can reduce a friction resistance at the time of inserting a male terminal, thereby reducing an insertion load and also reducing wear of contact portions.

(1) According to an illustrative aspect of the present invention, a connector device includes a first connector having a first connector housing and a male terminal held by the first connector housing, and a second connector having a second connector housing configured to engage with the first connector housing and a female terminal held by the second connector housing and configured to be electrically connected to the male terminal. The female terminal includes a cylindrical contact member having an inner diameter that is larger than an outer diameter of the male terminal in an initial state, a contact holder configured to accommodate the cylindrical contact member, and a rotary ring rotatably attached to the contact holder. A rotation mechanism is provided such that a relative rotation of respective ends of the cylindrical contact member, resulting from a rotation of the rotary ring in a state in which the first connector and the second connector are engaged with each other and the male terminal is inserted into the cylindrical contact member, causes a reduction in the inner diameter of the cylindrical contact member to electrically connect the cylindrical contact member and the male terminal with each other. The rotation mechanism includes a rotary ring operating mechanism configured to rotate the rotary ring by an operation from outside the first connector housing or the second connector housing.

(2) The rotary ring operating mechanism may include a slider having a cam projection and provided so as to be slidable in an axial direction with respect to the first connector housing or the second connector housing, and a cam groove provided on the rotary ring to convert an axial movement of the slider to a rotational movement of the rotary ring.

(3) The cylindrical contact member may include a pair of holding rings at the respective ends thereof, one of the holding rings being fixed to the contact holder in a non-rotatable manner, and the other holding ring being fixed so as to rotate together with the rotary ring. The cylindrical contact member may further include, as a diameter variable portion, a number of metal string members arranged at an interval in a circumferential direction in a state in respective ends of each of the metal string members are fixed to the holding rings, the metal string members forming a hyperboloid as a whole when the pair of the holding rings are twisted relative to each other in opposite directions from the initial state in which the metal string members extend parallel to an axial direction of the cylindrical contact member.

(4) The rotary ring operating mechanism may include, as a rotary ring fixing mechanism for retaining the rotary ring at a rotation end position, a lock hole provided in the slider and a lock projection provided on the first connector housing or the second connector housing.

(5) The connector device may include, as a linear guide mechanism for engaging the first connector and the second connector with each other, a base plate provided on one of the first connector housing and the second connector housing and a base frame provided on the other of the first connector housing and the second connector housing, the base frame having a guide groove configured to accommodate and to guide the base plate in a connector engaging direction.

According to the connector device having the structure as described above in item (1), in the initial state where the first connector and the second connector are engaged with each other, the inner diameter of the contact member in the cylindrical shape is set to be larger than the outer diameter of the male terminal inserted into the contact member. Therefore, the male terminal is inserted into the contact member in the cylindrical shape of the female terminal, in a state in which a clearance is secured with respect to the contact member. As a result, the male terminal is inserted into the female terminal, with almost no friction resistance with respect to the contact member. In this manner, it is possible to reduce an insertion resistance, and at the same time, to reduce a wear of the contact portions.

According to the connector device having the configuration of (1) described above, after the male terminal has been inserted, the respective ends of the contact member are rotated relative to each other and twisted in the opposite directions, by the rotary ring operating mechanism, from outside the first connector housing or the second connector housing. As a result, the diameter of the contact member can easily be reduced In this manner, an inner periphery of the contact member is brought into pressure contact with an outer periphery of the male terminal, and an electrically stable connection between the female terminal and the male terminal is made. Moreover, the electrically connected state between the female terminal and the male terminal is stably maintained.

According to the connector device having the configuration of (2) described above, by moving the slider, after the first connector and the second connector have been engaged with each other, the electrically stable connection between the female terminal and the male terminal is made. Moreover, by fixing the slider in this state, the electrically connected state between the female terminal and the male terminal is stably maintained.

According to the connector device having the configuration of (3) described above, by twisting the holding rings at the both ends of the contact member relatively in the opposite directions, the number of the metal string members forming the diameter variable portion can be deformed into the hyperboloid. Accordingly, the metal string members can be brought into pressure contact with the outer periphery of the male terminal, at a position having the smallest inner diameter of the hyperboloid. Therefore, because a number of contact points (contact points between the metal string members and the male terminal) exist along the entire circumference, a stable contact state between the male terminal and the female terminal can be obtained, and a temperature rise of the contact portions can be suppressed. Moreover, because a curvature of the diameter variable portion can be varied according to a twisting angle, a contact load with respect to the male terminal can be varied, and hence, it is possible to easily manage a contact resistance.

According to the connector device having the configuration of (4) described above, because the rotary ring operating mechanism has the rotary ring fixing mechanism, it is possible to hold the rotary ring at the rotation end position, thereby stably maintaining the contact state between the male terminal and the female terminal.

According to the connector device having the configuration of (5) described above, because there is the linear guide mechanism for guiding the first connector and the second connector, when they are engaged, the first connector and the second connector can be easily engaged with each other.

According to the present invention, on occasion of engaging the first connector with the second connector, when the male terminal is inserted into the cylindrical contact member of the female terminal, the clearance is secured between the contact member and the male terminal, and hence, abrasion resistance at the time of insertion can be reduced. Therefore, it is possible to reduce the insertion load, and also to reduce wear of the contact portions.

The present invention has been briefly described above. Details of the present invention will be further made clear by reading through a mode for carrying out the invention (hereinafter referred to as "an embodiment") described below, with reference to the accompanying drawings.

EMBODIMENTS OF INVENTION

Figure 1A:
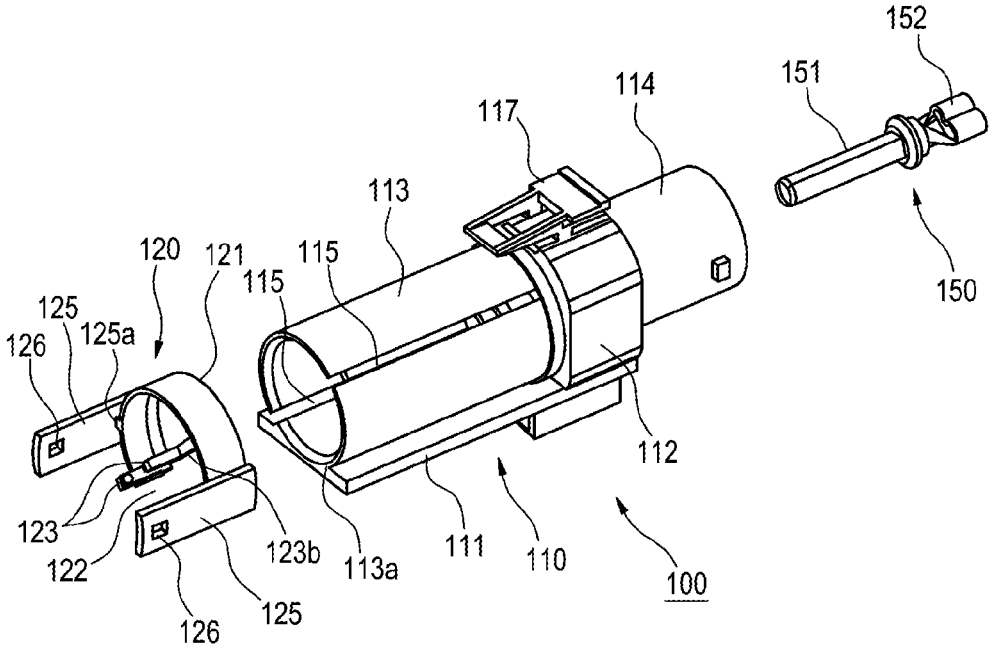
FIG. 1A is an exploded perspective view of a first connector in a connector device in an embodiment according to the invention.
Figure 1B:
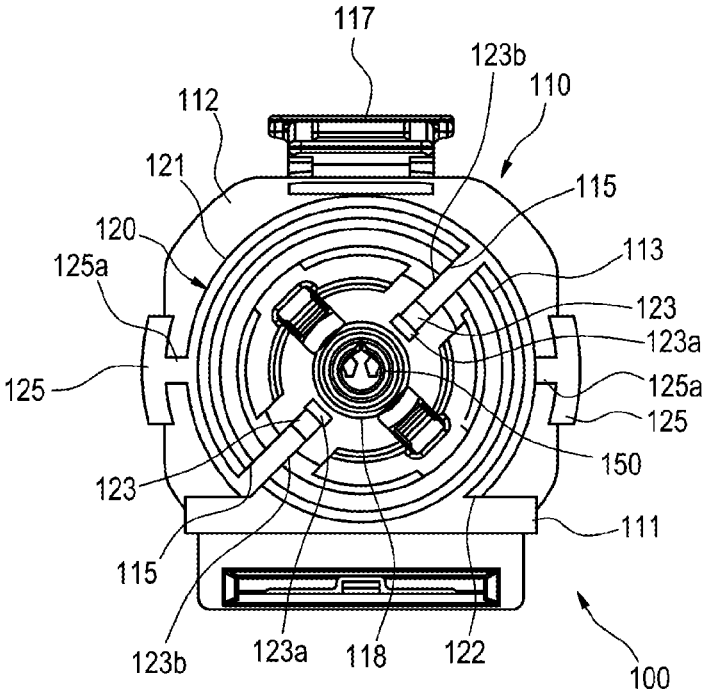
FIG. 1B is a front view of the first connector as shown in FIG. 1A.
Figure 2A:
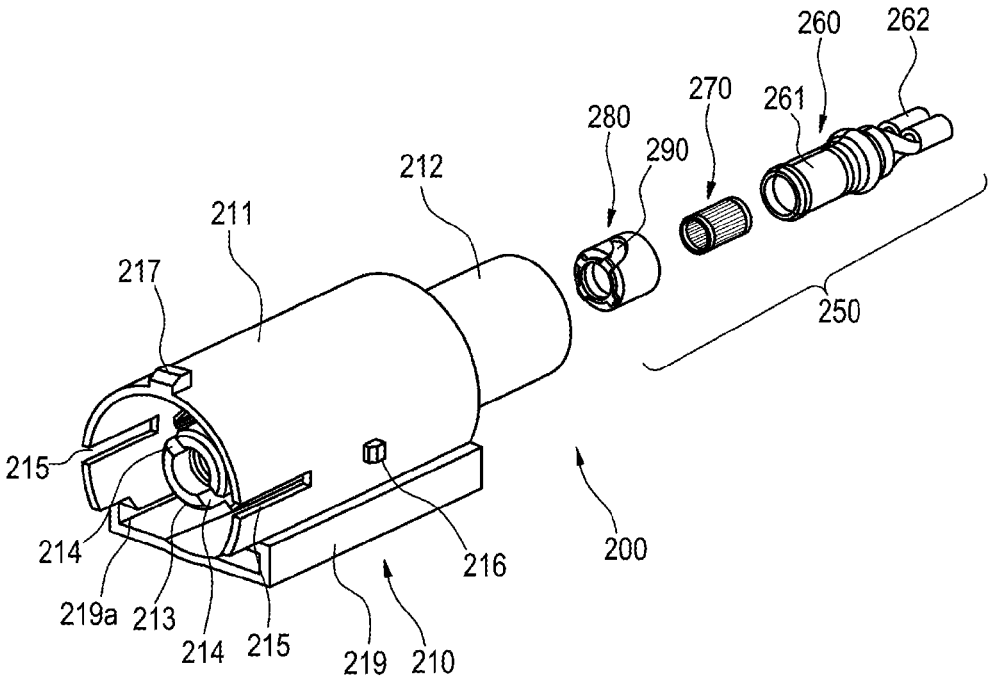
FIG. 2A is an exploded perspective view of a second connector in the connector device in the embodiment according to the invention.
Figure 2B:
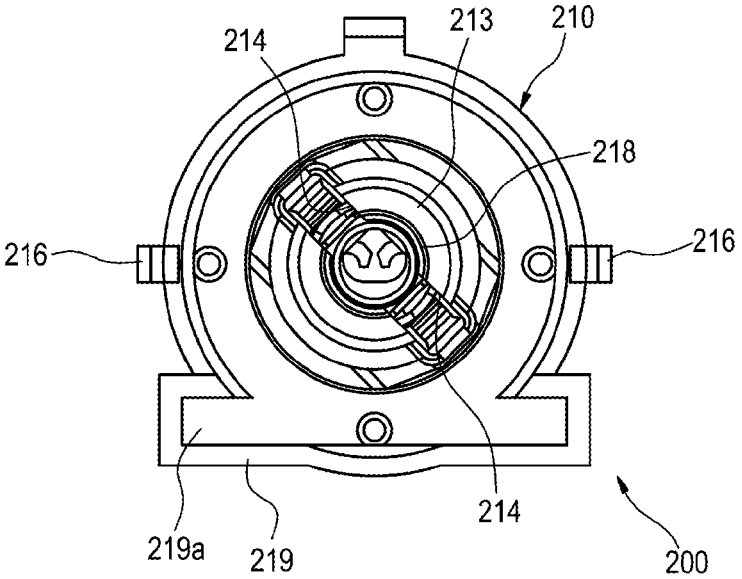
FIG. 2B is a front view of the second connector as shown in FIG. 2A.

Hereinafter, embodiments of the present invention will be described with reference to the drawings. A connector device according to an embodiment of the present invention includes a first connector 100 as shown in FIGS. 1A and 1B, and a second connector 200 as shown in FIGS. 2A and 2B. As shown in FIG. 1A, the first connector 100 includes a first connector housing 110, a slider 120 mounted to this first connector housing 110 so as to slide in an axial direction, and a pin-shaped male terminal 150 held inside the first connector housing 110.

As shown in FIG. 2A, the second connector 200 includes a second connector housing 210 adapted to be engaged with the first connector housing 110 of the first connector 100, and a female terminal 250 held inside this second connector housing 210. When the first connector 100 and the second connector 200 are accurately engaged with each other, and further, the slider 120 is slid from an initial position to an operation position, the female terminal 250 is electrically connected with the male terminal 150.

As shown in FIG. 1A, the first connector housing 110 has a base plate 111, a block part 112 fastened to a rear part of the base plate 111, a front side cylindrical tube portion 113 provided at a front side (a front side in a connector engaging direction) of the block part 112, and a rear side cylindrical tube portion 114 provided at a rear side (a rear side in the connector engaging direction) of the block part 112, all of which are formed into an integrally molded piece of insulating resin.

The front side tube portion 113 is fastened to the base plate 111 by means of a coupling portion 113*a* provided at a lower end of a peripheral wall thereof. The peripheral wall of the front side tube portion 113 is provided with two slide grooves 115 extending in an axial direction from a front end of the front side tube portion 113 to the block part 112, at two positions opposed at 180 degree in a circumferential direction.

On an upper end face of the block part 112, a lock mechanism 117 is provided. The lock mechanism 117 is locked to a lock projection 217 (see FIG. 2A) provided on the second connector housing 210, in a state in which the first connector housing 110 and the second connector housing 210 are accurately engaged with each other, thereby to lock the two connector housings 110, 210 to each other. Moreover, as shown in FIG. 1B, a terminal holding part 118 for holding the male terminal 150 is provided inside the first connector housing 110.

The male terminal 150 has a pin-shaped portion 151 inserted into the female terminal 250, at its front side, and a wire crimping portion 152 fixed to a terminal end of an electric wire, at its rear side. This male terminal 150 is inserted into the first connector housing 110, in such a manner that the pin-shaped portion 151 is directed frontward, and held at a fixed position by means of the terminal holding part 118.

The slider 120 is configured as an integrally molded piece of insulating resin in its entirety, and includes a ring portion 121 fitted to an outer periphery of the front side tube portion 113 in the first connector housing 110 so as to slide in the axial direction, a pair of lock arms 125 coupled to an outer peripheral face of the ring portion 121 by means of support legs 125*a* thereby to project frontward in parallel with each other, and a pair of cam arms 123 extending frontward and inward from a front end of the ring portion 121.

Figure 9:
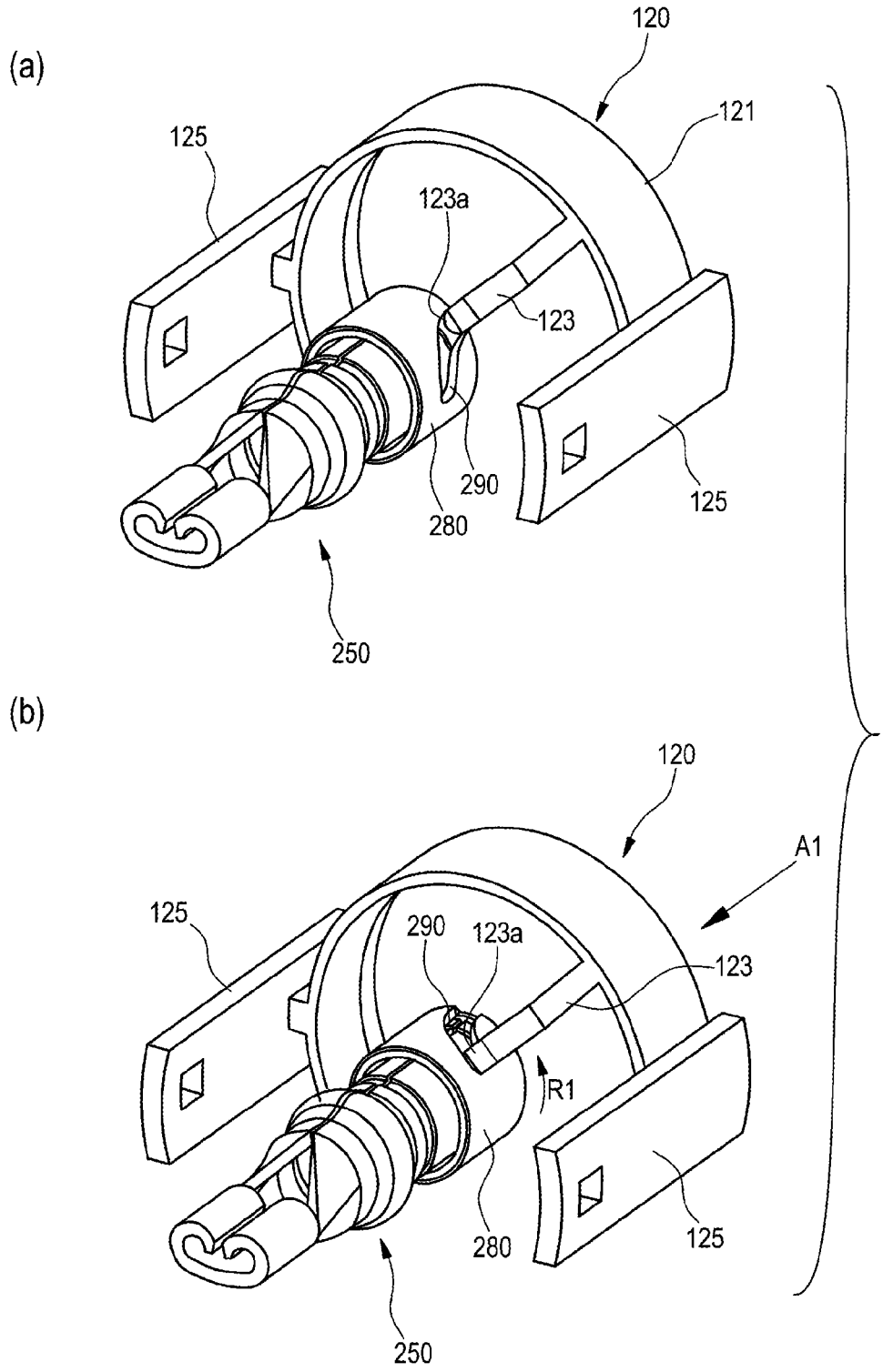
FIG. 9 includes views (a) and (b) illustrating relation between the slider and the female terminal, (a) of FIG. 9 being a perspective view illustrating a state before the slider is moved, and (b) of FIG. 9 being a perspective view illustrating a state where the rotary ring is rotated by actions of a cam projection and a cam groove, when the slider is moved.

Cam projections 123*a* slidably engaged with cam grooves 290 (see (a) and (b) of FIG. 5, and (a) and (b) of FIG. 9) in a rotary ring 280 of the female terminal 250, which will be described below, are provided at respective distal ends of the cam arms 123. The lock arms 125 are respectively formed with lock holes 126 engaged with lock projections 216 (see FIGS. 2A and 2B) provided on the second connector housing 210 thereby to lock the slider 120. The lock projections 216 and the lock holes 126 together form a rotary ring fixing mechanism configured to hold the rotary ring 280, which will be described below, at a rotation end position.

The ring portion 121 is provided with a cut-out part 122 for avoiding interference with respect to the coupling portion 113*a* which couples the front side tube portion 113 to the base plate 111. By aligning the cut-out part 122 with the coupling portion 113*a*, the ring portion 121 is engaged with the outer periphery of the front side tube portion 113 so as to slide in the axial direction. Base parts 123*b* of the cam arms 123 are slidably fitted to the slide grooves 115 of the front side tube portion 113, and hence, the lock arms 125 are disposed on the outer peripheral side of the front side tube portion 113.

On the other hand, as shown in FIG. 2A, the second connector housing 210 includes a base frame 219 having a guide groove 219*a* with which the base plate 111 of the first connector housing 110 is slidably engaged, a substantially cylindrical outer tube portion 211 disposed above the base frame 219, a rear side cylindrical tube portion 212 provided at a rear side of the outer tube portion 211, and an engaging tube portion 213 provided inside the outer tube portion 211, all of which are formed into an integrally molded piece of insulating resin. Specifically, the base plate 111 and the base frame 219 having the guide groove 219*a* for housing and guiding the base plate 111 along the connector engaging direction form a linear guide mechanism in the connector engaging direction. When the base plate 111 is inserted into the base frame 219, the first connector 100 is guided linearly with respect to the second connector 200, and thus, the first connector 100 and the second connector 200 can be easily engaged with each other.

The outer tube portion 211 is the part into which the front side tube portion 113 of the first connector housing 110 is to be inserted. The outer tube portion 211 is provided with slits 215 at the positions corresponding to the support legs 125*a* of the lock arms 125 of the slider 120. The support legs 125*a* are slidably fitted to the slits 215, when the front side tube portion 113 of the first connector housing 110 is inserted into the outer tube portion 211. Moreover, a lower half part of the outer tube portion 211 is integrated with the base frame 219.

Figure 6:
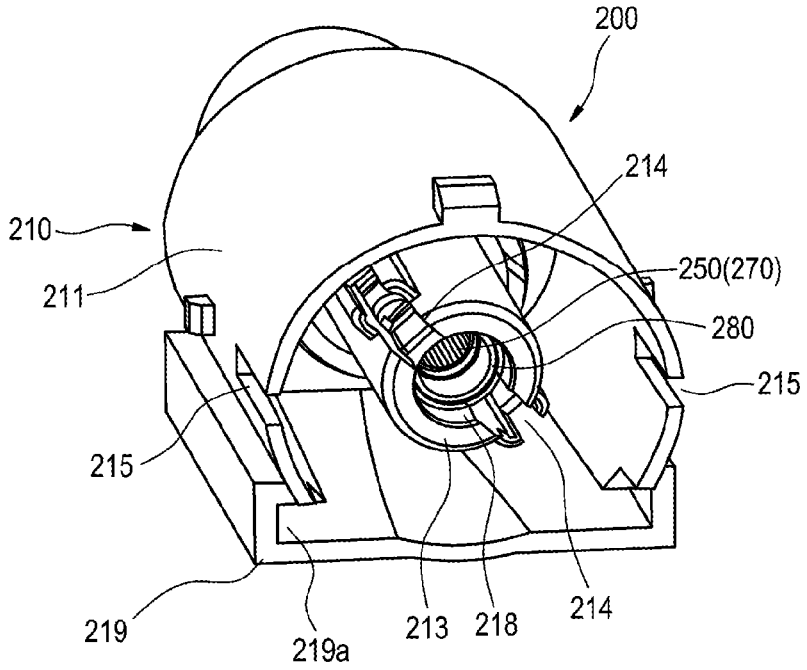
FIG. 6 is a perspective view of the second connector having the female terminal, as seen from a front side.

As shown in FIG. 2B and FIG. 6, a terminal support part 218 for holding the female terminal 250 is provided inside the engaging tube portion 213 of the second connector housing 210. This engaging tube portion 213 is the part to be engaged with the terminal holding part 118 of the first connector housing 110. The engaging tube portion 213 is provided with slide grooves 214 into which the cam arms 123 of the slider 120 are slidably inserted, on a peripheral wall thereof.

The outer tube portion 211 is provided with a lock projection 217 to be locked to the lock mechanism 117 of the first connector housing 110, on an upper face of a front end part of the outer periphery thereof and further provided with lock projections 216 to be locked to the lock holes 126 in the lock arms 125 of the slider 120, at right and left side parts of the outer periphery thereof.

Next, the female terminal 250 will be described. As shown in FIG. 2A, the female terminal 250 includes a terminal body 260 having a cylindrical contact holder 261 in a front part thereof and a wire crimping portion 262 in a rear part thereof, a cylindrical contact member 270 provided inside the cylindrical contact holder 261 of the terminal body 260 and into which the pin-shaped portion 151 (see FIG. 1A) of the male terminal 150 is inserted from a front side, and a rotary ring 280 rotatably fitted to a front end of the cylindrical contact holder 261. The terminal body 260 and the contact member 270 are formed of electrically conductive metal. The rotary ring 280 is formed of insulating resin.

Figure 3:
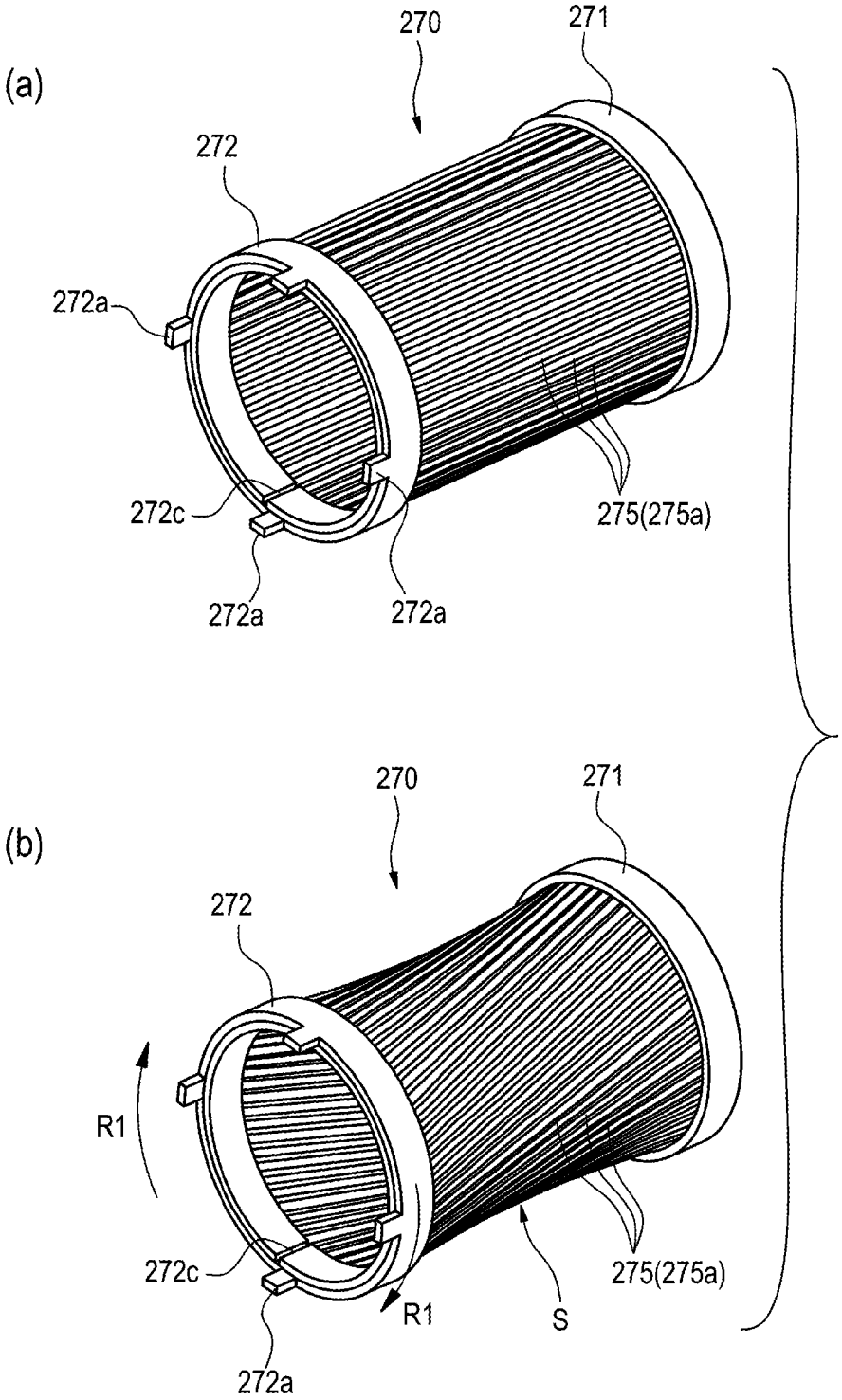
FIG. 3 includes perspective views (a) and (b) illustrating a structure of a contact member forming a female terminal shown in FIG. 2A, (a) of FIG. 3 being a view illustrating an initial state where the contact member is not twisted, and (b) FIG. 3 being a view illustrating a state where the contact member is twisted, and a diameter variable portion is deformed into a hyperboloidal shape.

As shown in (a) of FIG. 3 and (b) of FIG. 3, the cylindrical contact member 270 includes a pair of holding rings 271, 272 disposed at both ends thereof, and a diameter variable portion 275 whose opposite ends are held by a pair of the holding rings 271, 272. This diameter variable portion 275 is so set that in the initial state, its inner diameter d1 is larger than an outer diameter D of the pin-shaped portion 151 of the male terminal 150, as shown in (a) of FIG. 4, and contracted in diameter, when the holding rings 271, 272 are twisted relative to each other in opposite directions, to have a smaller diameter d2 than the outer diameter D of the pin-shaped portion 151 of the male terminal 150, as shown in (b) of FIG. 4.

This diameter variable portion 275 is formed as an assembly of a number of metal string members (for example, metal wires) 275*a* extending in an axial direction and arranged at a regular interval in a circumferential direction. These metal string members 275*a* are arranged at the regular interval in the circumferential direction in a state in which their both ends are fixed to the holding rings 271, 272. In the initial state, the metal string members are extended in parallel in the axial direction, as shown in (a) of FIG. 3 and (a) of FIG. 4. By twisting a pair of the holding rings 271, 272 in the opposite directions relative to each other, it is possible to deform an entirety of the metal string members 275*a* into a hyperboloid S from the initial state, as shown in (b) of FIG. 3 and (b) of FIG. 4.

Each of the holding rings 271, 272 is formed by rounding a narrow strip plate into a circle, leaving a small gap 271*c*, 272*c* at one position in a circumferential direction (the gap 271*c* of the rear side holding ring 271 is provided in the same manner as the gap 272*c* of the front side holding ring 272, although not shown in (a) and (b) of FIG. 3). These holding rings 271, 272 have outer diameters slightly larger than the inner diameter of the contact holder 261, in a natural state, and are provided inside the contact holder 261, while elastically contracted in diameter. Then, by releasing contraction of the diameter, outer peripheries of the holding rings 271, 272 are brought into pressure contact with an inner periphery 264 of the contact holder 261 by their elastic repulsive forces, and thus, the contact member 270 and the terminal body 260 are kept in an electrically connected state. It is to be noted that the inner diameters of the holding rings 271, 272 which are provided inside the contact holder 261 are of course set to be larger than the outer diameter D of the pin-shaped portion 151 of the male terminal 150.

Figure 4:
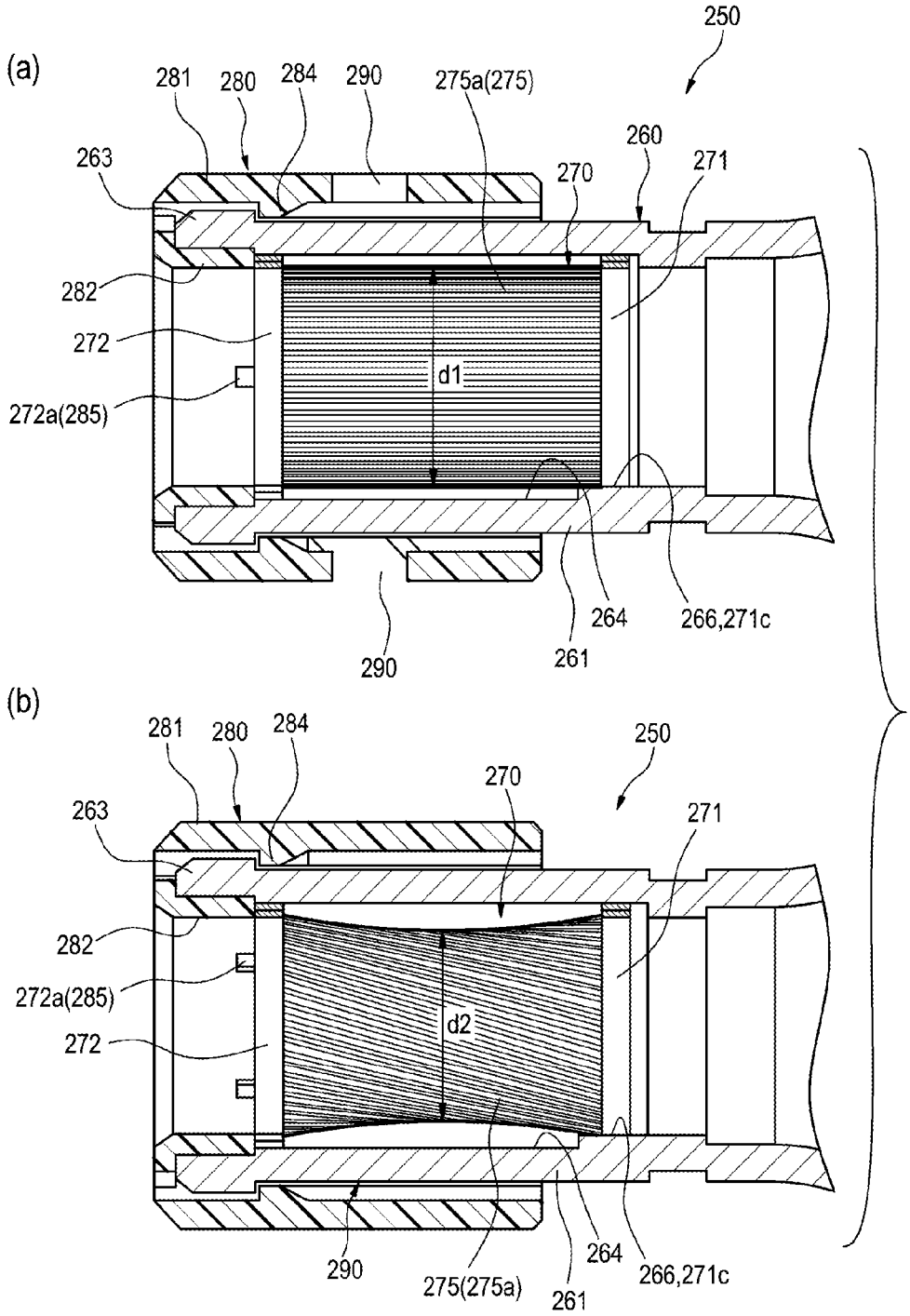
FIG. 4 includes longitudinal sectional views (a) and (b) of the female terminal shown in FIG. 2A, (a) of FIG. 4 being a view illustrating the initial state where the contact member is not twisted, and (b) of FIG. 4 being a view illustrating the state where the contact member is twisted, and the diameter variable portion is deformed into the hyperboloidal shape.

As shown in (a) and (b) of FIG. 4, the rear side holding ring 271 is housed and held inside the contact holder 261 in a non-rotatable but axially movable manner, because a rotation restraining rib 266 provided on the contact holder 261 enters into the gap 271*c* formed in the holding ring 271. The rotation restraining rib 266 provided on the contact holder 261 is set to have such an axial length that the rib 266 can be kept in a state inserted into the gap 271*c*, even when the contact member 270 is extended or contracted in the axial direction. With the rotation restraining rib 266 of the contact holder 261 being entered into the gap 271*c* in the holding ring 271, the holding ring 271 is configured so as not to rotate but axially movable with respect to the contact holder 261. On the other hand, the front side holding ring 272 is housed in the contact holder 261 in a rotatable manner.

As shown in (a) and (b) of FIG. 4, the rotary ring 280 has an outer peripheral cylindrical wall 281, an inner peripheral cylindrical wall 282, and an end wall interconnecting the outer peripheral cylindrical wall 281 and the inner peripheral cylindrical wall 282. In a state in which a projected part 263 at a front end of the cylindrical contact holder 261 is inserted between the outer peripheral cylindrical wall 281 and the inner peripheral cylindrical wall 282, an annular hook 284 of the outer peripheral cylindrical wall 281 is engaged with a stepped part in rear of the projected part 263 at the front end of the contact holder 261. In this manner, the rotary ring 280 is rotatably attached to the front end of the contact holder 261 in an undetachable manner.

The front side holding ring 272 of the contact member 270 is so constructed as to rotate together with the rotary ring 280, when engaging projections 272*a* projected from a front end thereof are engaged with engaged parts 285 formed on the inner peripheral cylindrical wall 282 of the rotary ring 280.

Figure 5:
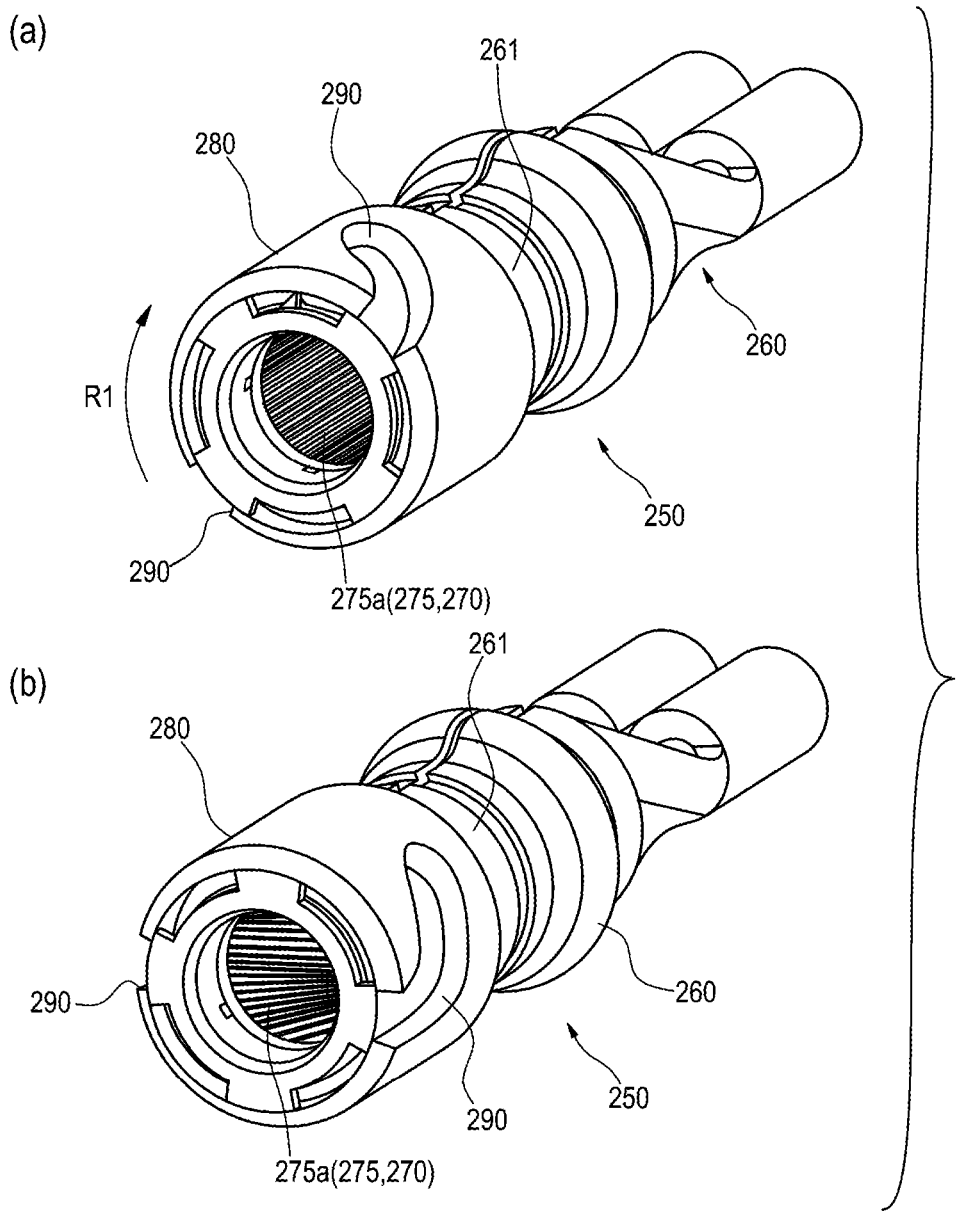
FIG. 5 includes structural views (a) and (b) of the female terminal as shown in FIG. 2A, (a) of FIG. 5 being a perspective view illustrating a state where a rotary ring is in an initial position, and (b) of FIG. 5 being a perspective view illustrating a state where the rotary ring is rotated from the initial position.

As shown in (a) and (b) of FIG. 5, the rotary ring 280 is formed with the cam grooves 290 extending from the front end toward the rear end in a diagonally curved shape with respect to the axial direction, on a peripheral face of the outer peripheral cylindrical wall 281. These cam grooves 290 are the parts with which the cam projections 123*a* of the cam arms 123 of the slider 120 are slidably engaged, and have functions of converting an axial movement of the slider 120 to a rotational movement of the rotary ring 280.

The lock holes 126 provided in the lock arms 125 of the slider 120 and the lock projections 216 provided on the second connector housing 210 form, in combination, a fixing mechanism for fixing the slider 120 in a state in which the rotary ring 280 has been rotated until the cylindrical contact member 270 is electrically connected to the male terminal 150. Further, this fixing mechanism, the cam grooves 290, and the cam projections 123*a* form, in combination, a rotary ring operating mechanism for rotating the rotary ring 280 according to necessity, and fixing the rotary ring 280 at a required position.

Next, operation of the above described connector device will be described. As shown in (a) of FIG. 11, when the first connector 100 and the second connector 200 are engaged with each other, the lock mechanism 117 provided on the first connector housing 110 is locked to the lock projection 217 provided on the second connector housing 210 thereby to lock the first connector 100 to the second connector 200.

Figure 10:
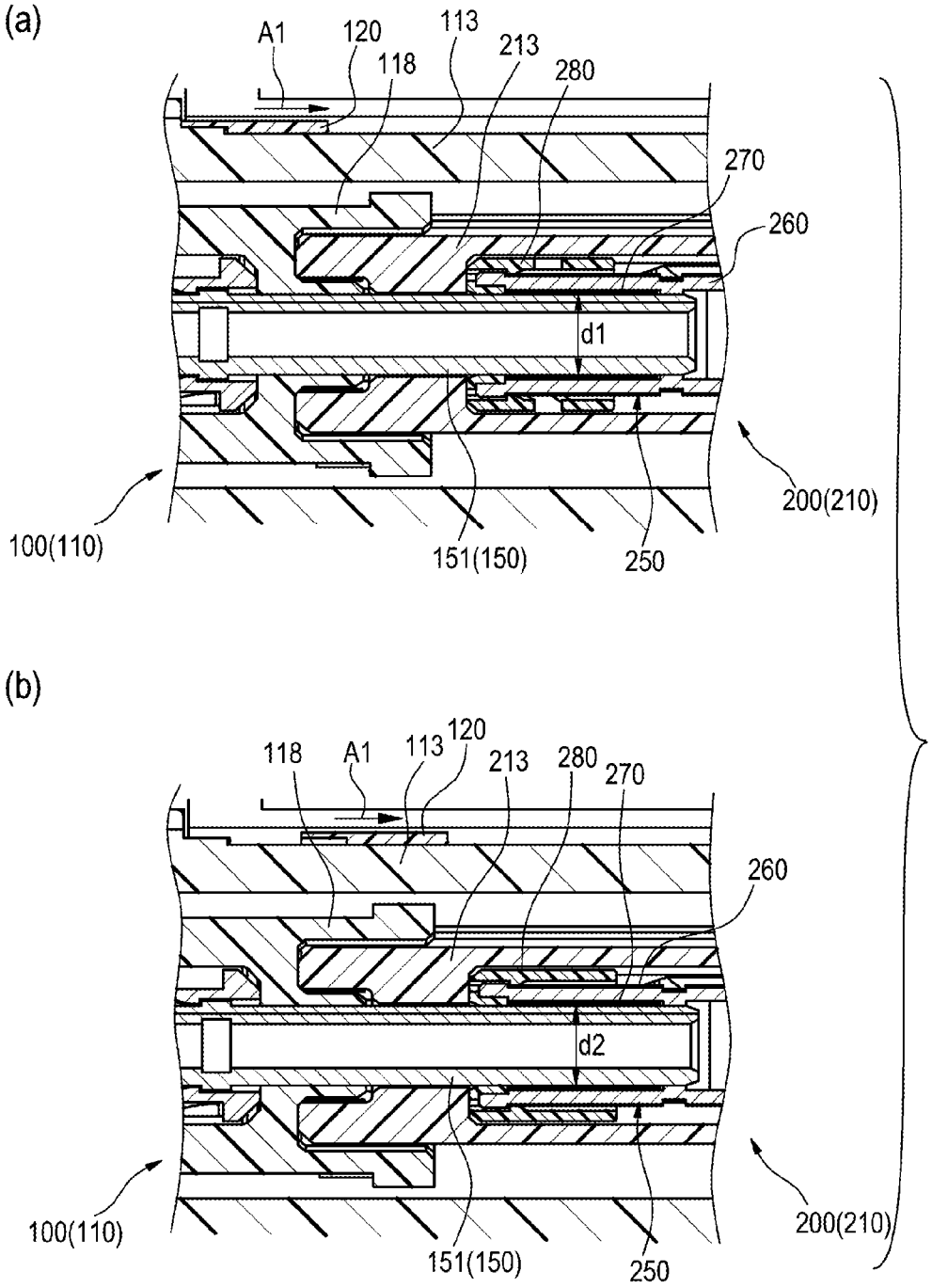
FIG. 10 includes sectional views (a) and (b) of the first connector and the second connector when they are engaged with each other, (a) of FIG. 10 being the sectional view illustrating the state before the slider is moved, and (b) of FIG. 10 being the sectional view illustrating a state after the slider has been moved.

Along with this engaging operation, the pin-shaped portion 151 of the male terminal 150 provided in the first connector 100 is inserted into the cylindrical contact member 270 of the female terminal 250 provided in the second connector 200, as shown in FIG. 10(*a*).

As also shown in (a) of FIG. 4, in the initial state where the rotary ring 280 is not rotated, the inner diameter d1 of the diameter variable portion 275 of the contact member 270 is set to be larger than the outer diameter of the pin-shaped portion 151 of the male terminal 150 inserted into the contact member 270. Therefore, when the pin-shaped portion 151 of the male terminal 150 is inserted into the female terminal 250, in this state, the pin-shaped portion 151 of the male terminal 150 is inserted into the contact member 270 of the female terminal 250, while securing a clearance with respect to the contact member 270. As a result, the pin-shaped portion 151 of the male terminal 150 is inserted into the female terminal 250, with almost no friction resistance with respect to the contact member 270. In this manner, it is possible to reduce an insertion resistance, and at the same time, to reduce wear of the contact portions.

In a stage where the first connector 100 and the second connector 200 have been engaged with each other, and the lock mechanism 117 has been locked to the lock projection 217, the operation proceeds to such a state that the pin-shaped portion 151 of the male terminal 150 is inserted into the contact member 270 of the female terminal 250.

Figure 7:
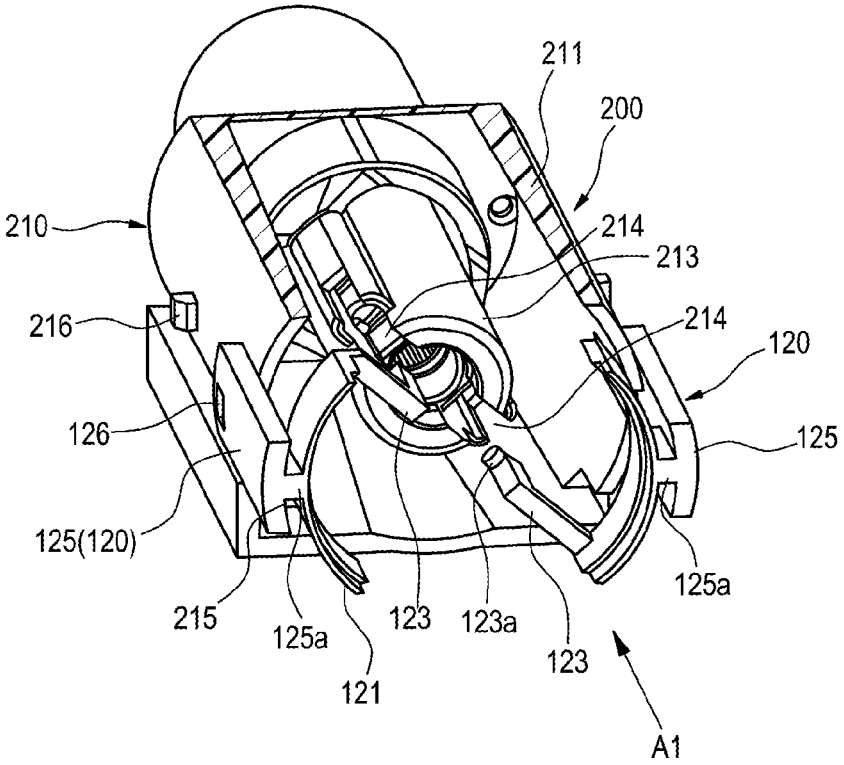
FIG. 7 is a perspective view partly cut away, illustrating relations between a slider and respective elements of the second connector, before the slider is moved, when the first connector is engaged with the second connector.
Figure 8:
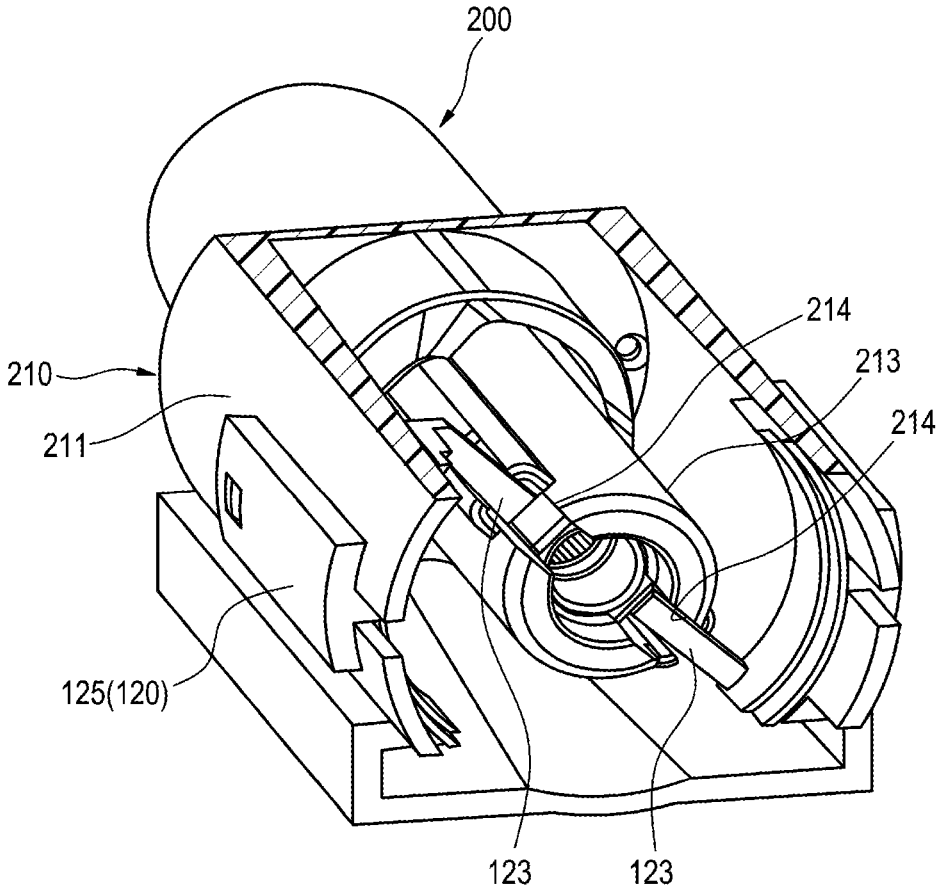
FIG. 8 is a perspective view partly cut away, illustrating relations between the slider and the respective elements of the second connector, in a state in which the slider has been moved, when the first connector is engaged with the second connector.

Thereafter, the slider 120 is slid toward the second connector 200, as shown by an arrow mark A1 in FIG. 7. Then, the cam arms 123 of the slider 120 are fitted into the slide grooves 214 in the engaging tube portion 213 of the second connector housing 210, as shown in FIG. 8. When the slider 120 is further slid, the cam projections 123*a* at the distal ends of the cam arms 123 are inserted into the cam grooves 290 in the rotary ring 280 of the female terminal 250, passing through the slide grooves 214 in the engaging tube portion 213, as shown in FIG. 9.

By further sliding the slider 120, the linear movement of the slider 120 in the direction of the arrow mark A1 is converted into the rotational movement of the rotary ring 280 in the direction of an arrow mark R1, by the cam actions of the cam grooves 290, and thus, the rotary ring 280 is rotated. Then, as shown in (b) of FIG. 3, (b) of FIG. 5, and (b) of FIG. 10, the front side holding ring 272 of the contact member 270 is rotated together with the rotary ring 280, and the front side holding ring 272 is twisted in the direction of the arrow mark R1 with respect to the rear side holding ring 271. As a result, a rear end side of the contact member 270 moves forward in the axial direction in a state in which the rotation is restricted by the rear side holding ring 271 because of actions of the rotation restraining rib 266 and the gap 271*c*, and the diameter variable portion 275 of the contact member 270 is contracted in diameter.

Specifically, because the holding rings 271, 272 at the both ends are twisted relative to each other, the diameter variable portion 275 formed by a number of the metal string members 275*a* is deformed into a hyperboloidal shape. As a result, the diameter variable portion 275 is brought into pressure contact with the outer periphery of the pin-shaped portion 151 of the male terminal 150, at a position having the smallest inner diameter d2 (<D) of the hyperboloid, as shown in (b) of FIG. 4 and (b) of FIG. 10.

As such, when the male terminal 150 is inserted into the cylindrical contact member 270 of the female terminal 250 to engage the first connector 100 and the second connector 200 with each other, the clearance is provided between the connect member 270 and the male terminal 150. Accordingly, the friction resistance in the inserting operation can be reduced. Therefore, it is possible to reduce the insertion load of the male terminal 150, and at the same time, to reduce wear of the contact portions.

Moreover, because a number of the metal string members 275*a* are brought into pressure contact with the outer periphery of the pin-shaped portion 151 of the male terminal 150, an electrically stable connection between the female terminal 250 and the male terminal 150 is made. Moreover, because a number of contact points exist along an entire circumference, temperature rise of the contact portions can be depressed. Further, because it is possible to vary contact loads of the metal string members 275*a* with respect to the male terminal 150, by varying a twisting angle of the diameter variable portion 275 according to a rotation angle of the rotary ring 280, management of a contact resistance can be easily achieved.

Figure 11:
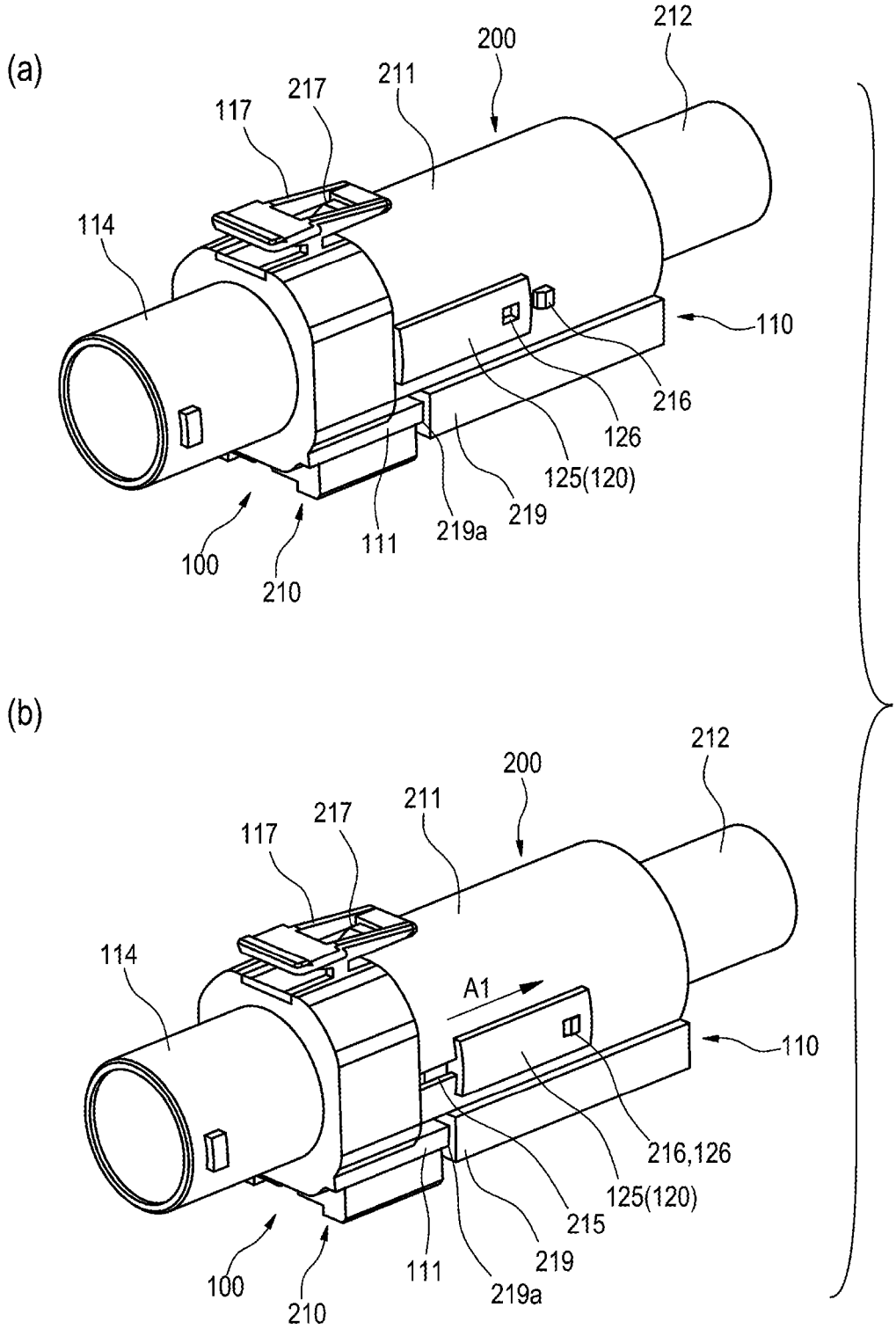
FIG. 11 includes perspective views (a) and (b) illustrating an external appearance of the first connector and the second connector when they are engaged with each other, (a) of FIG. 11 being the perspective view illustrating a state before the slider is moved, and (b) of FIG. 11 being the perspective view illustrating the state after the slider has been moved.
Figure 12:
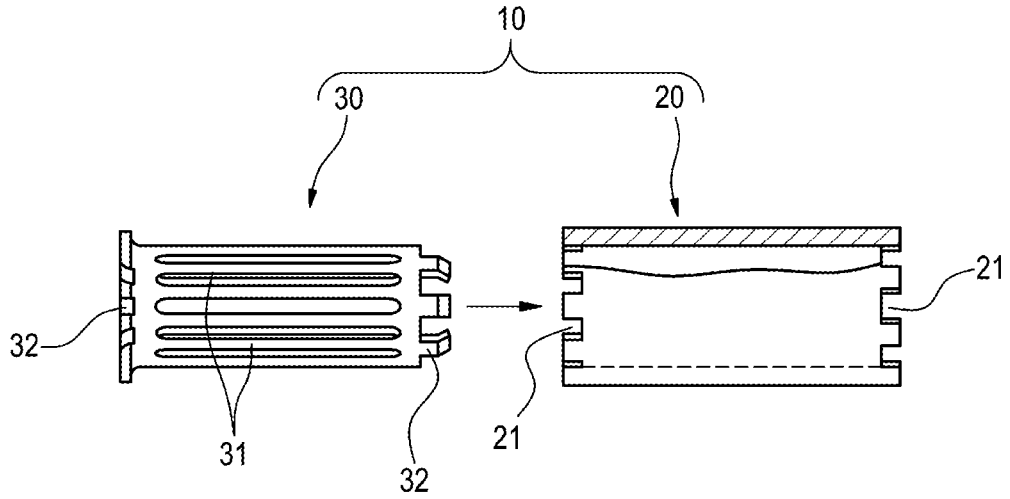
FIG. 12 is a structural view illustrating a conventional female terminal in a state before it is assembled.
Figure 13:
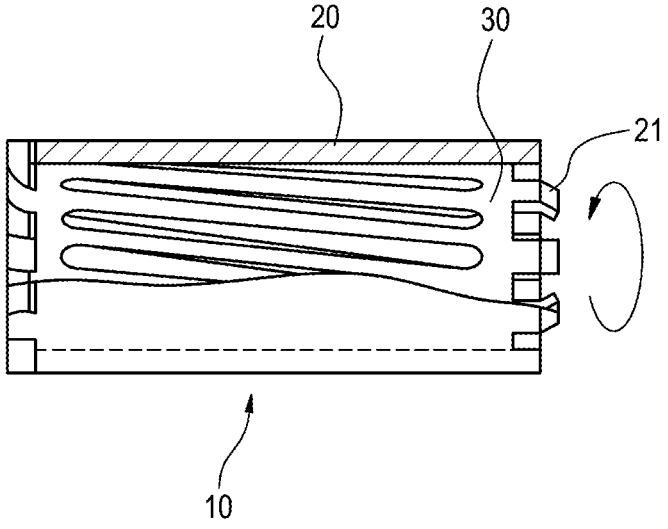
FIG. 13 is a structural view of the conventional female terminal.

Moreover, in a state in which a number of the metal string members 275*a* are in pressure contact with the outer periphery of the pin-shaped portion 151 of the male terminal 150, the lock holes 126 in the lock arms 125 of the slider 120 forming the rotary ring fixing mechanism are locked to the lock projections 216 of the second connector housing 210, as shown in (b) of FIG. 11. As a result, the slider 120 is fixed at this position (the rotation end position), and hence, the rotation position of the rotary ring 280 with respect to the contact holder 261 is fixed.

Because the rotation position of the rotary ring 280 is fixed, as described above, the diameter variable portion 275 of the contact member 270 is maintained in a diameter reduced state, and therefore, the electrical connection between the metal string members 275*a* and the pin-shaped portion 151 of the male terminal 150 is stably maintained.

The present invention is not limited to the embodiments described above, and changes and improvements may be made therein as appropriate. Moreover, materials, shapes, sizes, numbers, arranging locations and the like of respective elements in the embodiments above described are optional and not limited in so far as the present invention can be achieved.

For example, while the metal string members 275*a* are metal wires in the embodiment described above, the metal string members may be metal strips (small strips) having high resiliency.

Further, while an example in which the slider 120 is attached to the first connector housing 110 has been described in the embodiment described above, it is also possible to provide the slider on the second connector housing 210. Also, instead of providing the slider as the rotary ring operating mechanism, it is also possible to provide a mechanism for applying rotation to the rotary ring 280 by an external operation, in a state in which the first connector 100 and the second connector 200 are engaged with each other.

Here, features of the female terminal according to the embodiment of the present invention described above will be briefly summarized and listed in the following [1] to [5].

[1] A connector device including a first connector (100) having a first connector housing (110) and a male terminal (150) held by the first connector housing (110), and a second connector (200) having a second connector housing (210) configured to engage with the first connector housing (110) and a female terminal (250) held by the second connector housing (210) and configured to be electrically connected to the male terminal (150), the female terminal (250) including a cylindrical contact member (270) having an inner diameter that is larger than an outer diameter of the male terminal (150) in an initial state, a contact holder (261) configured to accommodate the cylindrical contact member (270), and a rotary ring (280) rotatably attached to the contact holder (261), wherein a rotation mechanism is provided such that a relative rotation of respective ends of the cylindrical contact member (270), resulting from a rotation of the rotary ring (280) in a state in which the first connector (100) and the second connector (200) are engaged with each other and the male terminal (150) is inserted into the cylindrical contact member (270), causes a reduction in the inner diameter of the cylindrical contact member (270) to electrically connect the cylindrical contact member (270) and the male terminal (150) to each other, and wherein the rotation mechanism includes a rotary ring operating mechanism (a slider 120, a cam projection 123*a*, and a cam groove 290) configured to rotate the rotary ring (280) by an operation from outside the first connector housing (110) or the second connector housing (210).

[2] The connector device as set forth in [1] described above, wherein the rotary ring operating mechanism includes a slider (120) having a cam projection (123*a*) and provided so as to be slidable in an axial direction with respect to the first connector housing (110) or the second connector housing (210), and a cam groove (290) provided on the rotary ring (280) to convert an axial movement of the slider (120) to a rotational movement of the rotary ring (280).

[3] The connector device as set forth in [1] or [2] described above, wherein the cylindrical contact member (270) includes a pair of holding rings (271, 272) at the respective ends thereof, one of the holding rings (271) being fixed to the contact holder (261) in a non-rotatable manner, and the other holding ring (272) being fixed so as to rotate together with the rotary ring (280), wherein the cylindrical contact member (270) further includes, as a diameter variable portion, a number of metal string members (275*a*) arranged at an interval in a circumferential direction in a state in which respective ends of each of the metal string members (275*a*) is fixed to the holding rings (271, 272), the metal string members (275*a*) forming a hyperboloid (S) as a whole when the pair of the holding rings (271, 272) are twisted relative to each other in opposite directions from the initial state in which the metal string members (275*a*) extends parallel to an axial direction of the cylindrical contact member (270).

[4] The connector device as set forth in [2] described above, wherein the rotary ring operating mechanism (the slider 120, the cam projection 123*a*, the cam groove 290) includes, as a rotary ring fixing mechanism for retaining the rotary ring (280) at a rotation end position, a lock hole (126) provided in the slider (120) and a lock projection (216) provided on the first connector housing (110) or the second connector housing (210).

[5] The connector device as set forth in any one of [1] to [4] described above, including, as a linear guide mechanism for engaging the first connector (100) and the second connector (200) with each other, a base plate (111) provided on one of the first connector housing (110) and the second connector housing (210), and a base frame (219) provided on the other of the first connector housing (110) and the second connector housing (210) the base frame having a guide groove (219*a*) configured to accommodate and to guide the base plate (111) in a connector engaging direction.

What is claimed is:

1. An electrical connector device comprising:

a first connector comprising a first connector housing and a male terminal held by the first connector housing, and a second connector comprising a second connector housing configured to engage with the first connector housing and a female terminal held by the second connector housing and configured to be electrically connected to the male terminal, the female terminal comprising a cylindrical contact member having a diameter variable portion and an inner diameter that is larger than an outer diameter of the male terminal in an initial state, a contact holder configured to accommodate the cylindrical contact member, and a rotary ring rotatably attached over the contact holder, wherein a rotation mechanism is provided in the second connector such that a relative rotation of respective ends of the cylindrical contact member, resulting from a rotation of the rotary ring in a state in which the first connector and the second connector are engaged with each other in an axial direction and the male terminal is inserted into the cylindrical contact member, causes a reduction in the inner diameter of the cylindrical contact member to electrically connect the cylindrical contact member and the male terminal with each other and wherein the rotation mechanism includes a rotary ring operating mechanism configured to rotate the rotary ring by an operation from outside the first connector housing or the second connector housing.

2. The electrical connector device according to claim 1, wherein the rotary ring operating mechanism comprises:

a slider comprising a cam projection and provided so as to be slidable in an axial direction with respect to the first connector housing or the second connector housing; and a cam groove provided on the rotary ring to convert an axial movement of the slider to a rotational movement of the rotary ring.

3. The electrical connector device according to claim 1, wherein the cylindrical contact member comprises a pair of holding rings at the respective ends thereof, one of the holding rings being fixed to the contact holder in a non-rotatable manner, and the other holding ring being fixed so as to rotate together with the rotary ring, wherein the cylindrical contact member further comprises, as the diameter variable portion, a plurality of metal string members arranged at an interval in a circumferential direction in a state in respective ends of each of the metal string members are fixed to the holding rings, the metal string members forming a hyperboloid as a whole when the pair of the holding rings are twisted relative to each other in opposite directions from the initial state in which the metal string members extend parallel to an axial direction of the cylindrical contact member.

4. The electrical connector device according to claim 2, wherein the rotary ring operating mechanism comprises, as a rotary ring fixing mechanism for retaining the rotary ring at a rotation end position, a lock hole provided in the slider and a lock projection provided on the first connector housing or the second connector housing.

5. The electrical connector device according to claim 1, comprising, as a linear guide mechanism for engaging the first connector and the second connector with each other, a base plate provided on one of the first connector housing and the second connector housing and a base frame provided on the other of the first connector housing and the second connector housing, the base frame comprising a guide groove configured to accommodate and to guide the base plate in a connector engaging direction.

* * * * *